US009183996B2

(12) United States Patent
Karlström et al.

(10) Patent No.: US 9,183,996 B2
(45) Date of Patent: Nov. 10, 2015

(54) HIGH VOLTAGE CURRENT INTERRUPTER AND AN ACTUATOR SYSTEM FOR A HIGH VOLTAGE CURRENT INTERRUPTER

(75) Inventors: Per-Olof Karlström, Almeria (ES); Thomas R. Eriksson, Bälinge (SE); Ener Salinas, Västerås (SE); Ara Bissal, Stockholm (SE)

(73) Assignee: ABB TECHNOLOGY LTD, Zürich (CH)

( * ) Notice: Subject to any disclaimer, the term of this patent is extended or adjusted under 35 U.S.C. 154(b) by 0 days.

(21) Appl. No.: 14/406,828

(22) PCT Filed: Jun. 27, 2012

(86) PCT No.: PCT/EP2012/062480

§ 371 (c)(1),
(2), (4) Date: Apr. 21, 2015

(87) PCT Pub. No.: WO2014/000790

PCT Pub. Date: Jan. 3, 2014

(65) Prior Publication Data

US 2015/0235784 A1 Aug. 20, 2015

(51) Int. Cl.
*H01H 3/46* (2006.01)
*H01H 3/60* (2006.01)
(Continued)

(52) U.S. Cl.
CPC . *H01H 3/60* (2013.01); *H01H 1/50* (2013.01); *H01H 33/666* (2013.01)

(58) Field of Classification Search
CPC . H01H 33/42; H01H 33/66; H01H 2221/024; H01H 33/666; H01H 3/46
See application file for complete search history.

(56) References Cited

U.S. PATENT DOCUMENTS 3,539,747 A * 11/1970 Robinson ..... 218/135
4,086,645 A 4/1978 Gorman et al.
(Continued)

FOREIGN PATENT DOCUMENTS

CN 201751971 U 2/2011
CN 102184795 A 9/2011
(Continued)

OTHER PUBLICATIONS

Bissal et al., "Simulation and verification of Thomson actuator systems", Excerpt from the Proceedings of the COMSOL Conference 2010 Paris, Session AC/DC Systems, Nov. 2010, 6 pages.
(Continued)

*Primary Examiner* — Truc Nguyen
(74) *Attorney, Agent, or Firm* — Birch, Stewart, Kolasch & Birch, LLP

(57) ABSTRACT

An actuator system for actuating a high voltage current interrupter is disclosed. The actuator system comprises a transmission link for transmitting kinetic energy from a force provision system to a moveable contact of the current interrupter. The transmission link has a first end which is mechanically connectable to the moveable contact of the current interrupter and a second end facing away from the moveable contact. The actuator system further comprises a damping system comprising a shock-absorbing mass. The shock-absorbing mass is located along the extension of the line of translational movement of the transmission link, at the farther side of the transmission link as seen from the current interrupter, so that upon an opening operation of the current interrupter, the second end of the transmission link will collide with the shock-absorbing mass.

20 Claims, 7 Drawing Sheets

(51) Int. Cl.
*H01H 33/666* (2006.01)
*H01H 1/50* (2006.01)

(56) References Cited

U.S. PATENT DOCUMENTS

| | | | | |
|---|---|---|---|---|
| 5,059,753 | A * | 10/1991 | Hamm | 218/84 |
| 6,580,345 | B2 | 6/2003 | Akita et al. | |
| 7,598,468 | B2 * | 10/2009 | Chen et al. | 200/400 |
| 7,696,447 | B2 * | 4/2010 | Chen et al. | 200/400 |
| 2006/0131154 | A1 * | 6/2006 | Fitzer et al. | 200/400 |
| 2015/0108090 | A1 * | 4/2015 | Oates et al. | 218/10 |
| 2015/0114933 | A1 * | 4/2015 | Reuber et al. | 218/140 |
| 2015/0116878 | A1 * | 4/2015 | Richard et al. | 361/71 |

FOREIGN PATENT DOCUMENTS

| | | | |
|---|---|---|---|
| EP | 0 867 903 | A2 | 9/1998 |
| EP | 1 998 351 | A1 | 12/2008 |
| FR | 2 815 463 | A1 | 4/2002 |
| GB | 1157015 | | 7/1969 |
| GB | 1172091 | | 11/1969 |
| JP | 2011-76758 | A | 4/2011 |
| WO | WO 2011/045062 | A1 | 4/2011 |

OTHER PUBLICATIONS

Dullni et al., "Totally maintenance-free: new vacuum circuit-breaker with permanent magnet actuator", 1997, No. 11, pp. 1205-1212.

* cited by examiner

HIGH VOLTAGE CURRENT INTERRUPTER AND AN ACTUATOR SYSTEM FOR A HIGH VOLTAGE CURRENT INTERRUPTER

TECHNICAL FIELD

The present invention relates to high voltage current interrupters and the actuation thereof.

BACKGROUND

In high voltage systems, it is of great importance that the current through a transmission line can be interrupted in case of a line fault, in order to protect system equipment and system users from damage caused by the fault current. Circuit breakers are therefore provided in order to allow the interruption of a fault current. In direct current (DC) systems, the inductance of a transmission line will only limit the current in the initial transient stage, and the steady state impedance of a transmission line will thus be low. In order to prevent a fault current from growing beyond an acceptable level, a DC circuit breaker is typically connected in series with a large reactor. To maintain system stability and avoid damage to the system, a short breaking time of the DC circuit breaker is desired.

The breaking time of a mechanical DC circuit breaker is largely dependent on the opening time of the mechanical interrupter. Therefore, mechanical interrupters of high opening speed are desired.

SUMMARY

A problem to which the present invention relates is how to obtain a fast and robust high voltage circuit breaker.

This problem is addressed by an actuator system for actuation of a current interrupter having a fixed contact and a moveable contact. The actuator system comprises a transmission link for transmission of a force to the moveable contact of the current interrupter, the transmission link having a first end which is mechanically connectable to the moveable contact of the current interrupter and a second end facing away from the moveable contact. The actuator system further comprises a damping system comprising a shock-absorbing mass. The shock-absorbing mass is located along an extension of a line of translational movement of the transmission link, at the farther side of the transmission link as seen from the current interrupter, so that upon an opening operation of the current interrupter, the second end of the transmission link will collide with the shock-absorbing mass.

By the actuator system is achieved that also current interrupters of small contact stroke can provide a very fast current interruption, since the transmission link can be brought to a halt over a very short distance even when the speed of movement of the transmission link is high. The mass of the shock-absorbing mass can for example be selected to lie within the range of 50-150% of the sum of the mass of the transmission link and the mass of the moveable contact, so that a large part of the momentum of the travelling parts will be transferred to the shock-absorbing mass in a collision.

In one embodiment, the transmission link comprises a shock-mitigation spring arranged to mitigate the shock experienced by the moveable contact in a damping action. The shock-mitigation spring is arranged to provide elasticity to the transmission link in the direction of the translational movement of the transmission link. The mass of the travelling parts, which comprises the mass of the moveable contact and the mass of the transmission link, will then form two different parts separated by the shock-mitigation spring, said masses here referred to as the nearer mass (which is nearer to the fixed contact) and the farther mass (which is further away from the fixed contact). Said two masses, although linked, will be able to experience different acceleration/deceleration.

By providing a shock-mitigation spring in the transmission link, the risk of damage to the actuator system due to high speed collisions will be greatly reduced.

The shock-mitigation spring can for example be arranged between the first end of the transmission link and a drive rod, the drive rod being arranged between the shock-mitigation spring and the armature. By providing the shock-mitigation spring at a location close to the moveable contact, a larger part of the travelling mass will initially experience the force on the transmission link in an opening action than if the spring is located further away from the moveable contact, if the force transmission system exerts a force on said second end of the transmission link. For force provision systems for which the generated force is largest at the beginning of the opening actions, such as a force provision system based on Thomson coils, this is typically advantageous.

In one embodiment, the actuator system comprises a contact spring arranged to be compressed by a pre-defined distance when the current interrupter is in the closed position, so that a spring force is exerted on the moveable contact towards the fixed contact. Such contact spring can ensure good galvanic contact also when the contact surfaces of the current interrupter get worn. In an actuator system having both a contact spring and a shock-mitigation spring, the contact spring can be co-located with the shock-mitigation spring. Such co-location of the contact spring and the shock-mitigation spring has the advantage that the transmission link will be divided into two linked masses only, and that any collision between these two linked masses will be mitigated by the shock-mitigation spring.

The spring constant of the shock-mitigation spring will be considerably larger than that of the contact spring, and typically ten times larger or more.

The spring constant, $k_{400}$, of the shock-mitigation spring can advantageously fulfill the following relation:

$$k_{400} = \left(\frac{M1M2}{M1 + M2}\right)\left(\frac{2\pi}{2\tau}\right)^2,$$

where M1 is the mass of the part of the transmission link which is further away from the moveable contact than is the shock-mitigation spring (the farther mass); M2 is the mass of the moveable contact and the part of the transmission link that is closer to the moveable contact than is the shock-mitigation spring (the nearer mass); and $\tau$ takes a value between $0.1T_{open}$ and $0.7T_{open}$, where $T_{open}$ is the opening time of the current interrupter. Hereby is achieved that the number of collisions between the masses M1 and M2 will be kept low, while sufficient shock mitigation will be provided.

The masses of the nearer mass and the farther mass could for example be approximately equal, so that the ratio of the further mass to the nearer mass takes a value between 0.8 and 1.2. By designing the actuator system so that the nearer and farther masses are approximately equal, the two masses will travel more or less together in the part of the opening scenario which occurs after the transmission link has collided with the shock-absorbing mass, thus reducing the risk of further collisions.

The actuator system can include a bi-stable mechanism whereby a force is exerted on the transmission link in the direction towards the moveable contact when the current interrupter is in the closed position. The bi-stable mechanism could be an intrinsic property of a force provision system arranged to provide a force on the transmission link in order to bring the current interrupter into the open state, or external to such system.

The shock-mitigation spring then typically provides a spring constant such that the force exerted by the shock-mitigation spring exceeds the force exerted by the bi-stable mechanism at a compression of the shock-mitigation spring which corresponds to less than 10% of the stroke of the shock-mitigation spring.

The inventive actuator system can be used in current interrupters for both ac and dc systems.

Further aspects of the invention are set out in the following detailed description and in the accompanying claims.

DETAILED DESCRIPTION

In many applications of high voltage current interrupters, a short opening time of the current interrupter is desired. For example, in many High Voltage Direct Current (HVDC) applications, an opening time of 5 ms or less is desired.

Figure 1B:
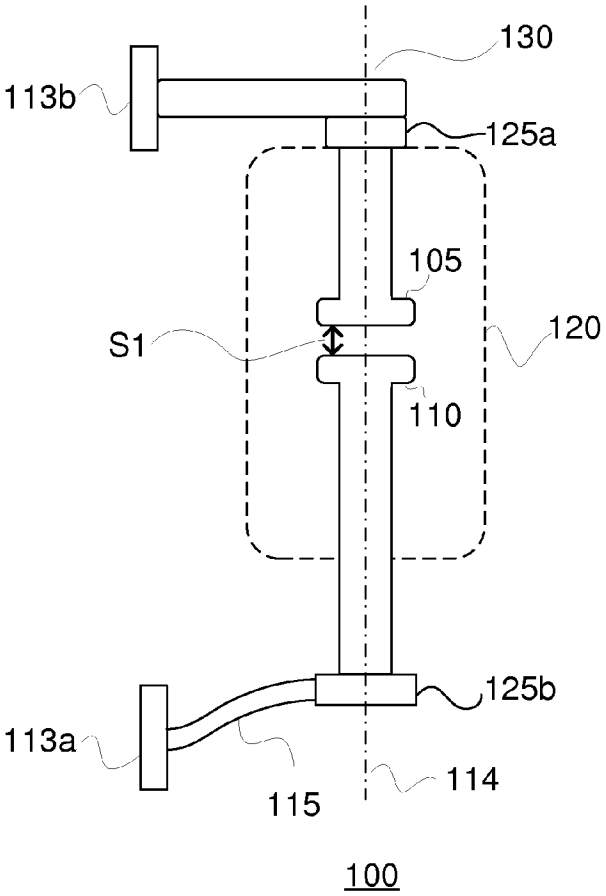
FIG. 1*b* illustrates the vacuum interrupter of FIG. 1*a* in the open position.
Figure 1A:
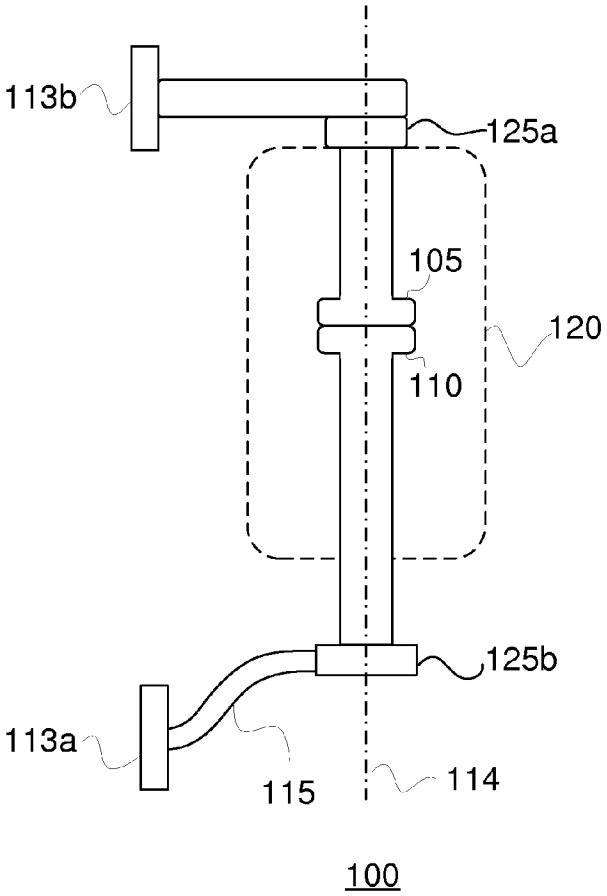
FIG. 1*a* illustrates an example of a vacuum interrupter in the closed position.

In a mechanical current interrupter, the opening of the current interrupter is typically achieved by a moveable contact being pulled or pushed away from a fixed contact of the interrupter. An example of a mechanical current interrupter 100 having a fixed contact 105 and a moveable contact 110 is schematically shown in FIGS. 1*a* and 1*b*. In FIG. 1*a*, the interrupter 100 is in the closed position, while in FIG. 1*b*, the interrupter is in the open position. The distance between the fixed contact 105 and the moveable contact 110 in the open position is referred to as the contact stroke S1, and is indicated in FIG. 1*b* by means of an arrow. The movement of the moveable contact 110 upon opening and closing takes place along a straight line. This line, and the extension thereof in both directions, is here referred to as the translation line 114. The translation line 114 is indicated by means of a dashed line in FIGS. 1*a* and 1*b*.

The interrupter 100 of FIGS. 1*a* and 1*b* is further shown to comprise a first external terminal 113*a* connected to the moveable contact 110 via a flexible electrical connection 115, as well as a second external terminal 113*b* connected to the fixed contact 105. Examples of possible attachment interfaces 125*a,b* between the external terminals 113*a,b*, and the fixed and moveable contacts, respectively, are also shown. The current interrupter 100 of FIGS. 1*a* and 1*b* is shown to be a Vacuum Interrupter (VI), wherein the fixed and moveable contacts are contained within a vacuum flask 120. The interrupter 100 of FIGS. 1*a* and 1*b* is given as an example only, and the invention can be applied to other designs of current interrupters 100. For example, the invention is not limited to vacuum interrupters, but could also be applied to the actuation of other types of current interrupters, such as gas interrupters.

In order to attain a short opening time in a mechanical current interrupter 100, the initial acceleration of the moveable contact 110 has to be high, implying that a large force has to be exerted on the moveable contact 110 in order to accelerate the moveable contact 110. The kinetic energy of the moveable 110 will thus be increased. Such large force is provided by means of a force provision system and a transmission link. A force provision system gives rise to a force which accelerates the transmission link, and the transmission link is mechanically linked to the moveable contact 110 so that the acceleration of the moveable contact 110 is linked to the acceleration of the transmission link.

Different kinds of force provision systems are known in the art. Force provision systems based on electromagnetic actuation typically comprises at least one coil which is connected to a current source, such as a charged capacitor or capacitor bank. By letting a large current flow through such coil, a magnetic field is generated. The transmission link in an actuator system which is based on electromagnetic actuation typically comprises an armature, which is made from a material which interacts with the strong magnetic field, so that the armature is attracted or repelled when a current is allowed to flow through the coil.

An example of a suitable force provision system based on electromagnetic actuation, which can give rise to a high acceleration of the moveable contact 110, is a force provision system based on eddy current repulsion, for which the armature of the transmission link comprises an electrically conducting material in which eddy currents will be generated by the magnetic field. The coils in an eddy current repulsion system are often referred to as Thomson coils. Other examples of electromagnetic force provision systems which can give rise to a high force are a force provision system based on ferromagnetic attraction, for which the armature comprises a ferromagnetic material, and force provision systems based on attraction or repulsion of permanent magnets, for which the armature comprises permanent magnets.

A force provision system based on mechanical repulsion could also be contemplated, such as for example an electromagnetically accelerated ball which hits the armature of the transmission link at high speed, or a spring operated force provision system. In such implementations, the armature of the transmission link 204 would be designed to have suitable mechanical properties.

Combinations of different force provision systems can also be used, where for example one type of force provision system is used for the opening operation of the current interrupter 100, and another type of force provision system is used for the closing of the current interrupter 100. The armature of the transmission link would then be designed accordingly.

In the following, the invention will be described in terms of an actuator system having a force provision system based on two Thomson coils—one to actuate the opening of the current interrupter 100, and one to actuate the closing of the current interrupter 100. This is for illustrative purposes only, and any other suitable force provision system could be used. An example of a force provision system based on Thomson coils is described in Bissal, Engdahl, Salinas, and Ohrstrom, "*Simulation and verification of Thomson actuator systems*", Proceedings of COMSOL conference Paris, Session AC/DC Systems, November 2010.

Figure 2A:
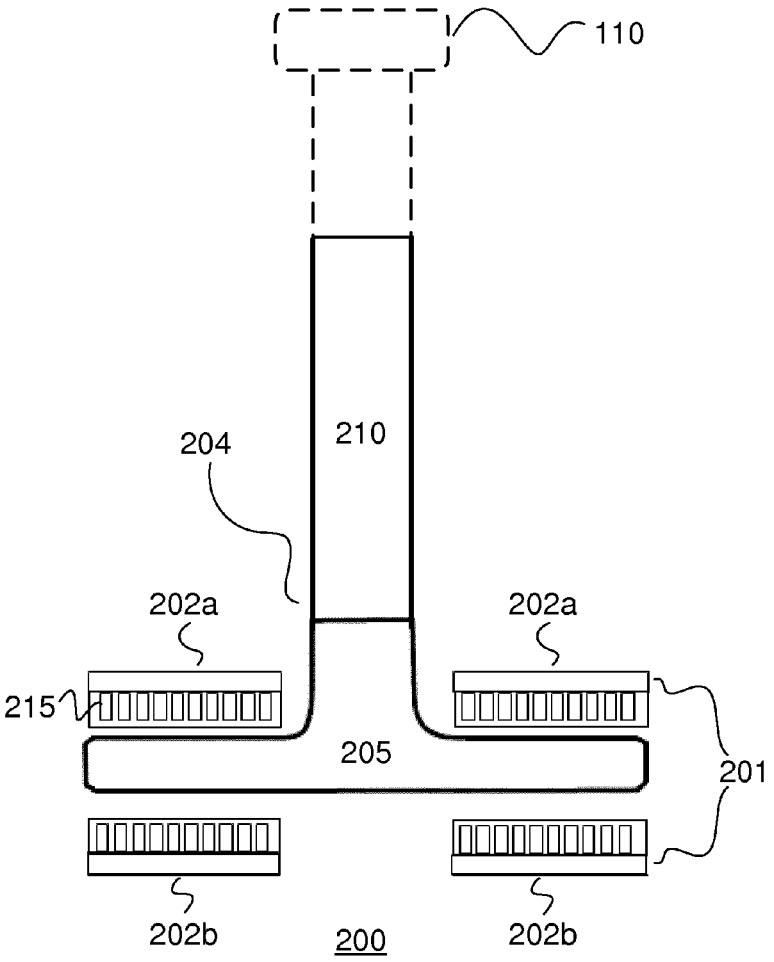
FIG. 2*a* schematically illustrates an example of an actuator system comprising a force provision system and a transmission link.

A cross section of an example of an actuator system 200 wherein the force provision system 201 is based on Thomson coils is schematically illustrated in FIG. 2*a*. The force provision system 201 of FIG. 2*a* comprises two Thomson coils 202*a* and 202*b*, respectively. In order to distinguish between the two Thomson coils, they will be referred to as the nearer Thomson coil 202*a* and the farther Thomson coil 202*b*, respectively, where the nearer Thomson coil 202*a* is the Thomson coil which is closest to the current interrupter 100 and the farther Thomson coils 202*b* is the Thomson coil which is further way from the current interrupter 100. When referring to either or both Thomson coils, the reference numeral 202 will be used.

FIG. 2*a* further illustrates a transmission link 204 comprising an armature 205 connected to a drive rod 210. Each of the Thomson coils 202*a,b* comprises a conductor wound in a number of turns 215, the conductor being connected to a current source (not shown) via a switch (not shown). When using a force provision system based on eddy current repulsion, the armature 205 comprises an electrically conducting material, e.g. Al or Cu. Alternatively, the armature 205 could also include a coil, which is connected to a current source in a manner so that the current through the armature coil would be of the opposite direction to the current through the corresponding Thomson coil 202. The current source supplying such armature coil could, if desired, be the same current source that supplies current to the Thomson coil 202. Such armature coil/Thomson coil system can be referred to as a double Thomson coil system.

Figure 4:
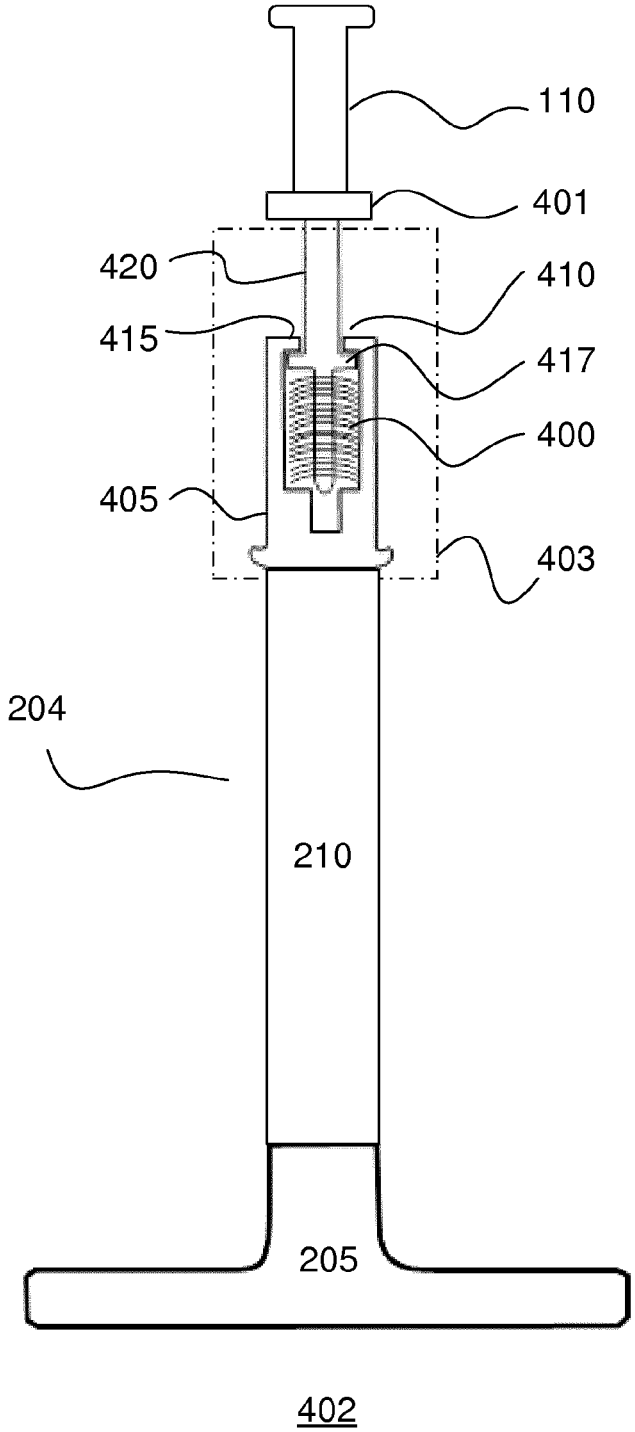
FIG. 4 illustrates an example of a transmission link connected to a moveable contact.

The drive rod 210 shown in FIG. 4 is connected to the armature 205 at one end, and connectable to the moveable contact 110 of a current interrupter 100 at the other end. In the following, the term "travelling parts" will be used to refer to the combination of the transmission link 204 and the moveable contact 110.

For illustration purposes, the armature in FIG. 2*a* (and in FIG. 3) is located at a position between the closed state and the open state. In an implementation of the invention, the illustrated position will only occur during a very short period of time upon closing or opening of the current interrupter 100. At all other instants, the actuator system 200 will either be in the closed state, in which the armature 205 will be located tightly to the nearer Thomson coil 202*a*, or in the open state, in which the armature 205 will be located tightly to the farther Thomson coil 202*b*.

Figure 2B:
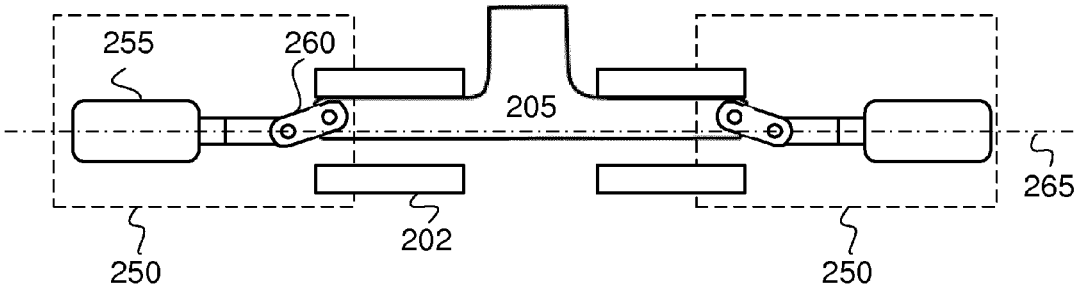
FIG. 2*b* illustrates an example of an armature connected to bi-stable mechanisms, which ensure that the number of stable positions of the armature is two.

In order to ensure that the transmission link 204 only has two stable positions, i.e. the positions corresponding to an open or closed interrupter 100, the actuator system 200 typically includes a bi-stable mechanism. In one implementation, the bi-stable mechanism is implemented by means of latches which lock the armature in the desired position, and which will unlock when a force of a particular strength is applied along the translation line 114. In another implementation, the bi-stable mechanism is implemented by means of springs, which at at least one position between the open and closed positions of the armature is compressed in a direction perpendicular to the translation line 114. In this implementation, the springs are mechanically connected to the armature 205, e.g. via double acting hinges, so that in the open and closed positions, a force will be exerted on the armature 205 along the translation line 114. An example of a bi-stable mechanism according to this implementation is given in FIG. 2*b*, which is a cross-sectional view of an armature 205 which is connected to a fixed actuator supporting frame (not shown) via bi-stable mechanisms 250. The cross-section of FIG. 2*b* is taken along a plane which includes two bi-stable mechanisms 250, each comprising a spring 255 which exerts a force on the armature 205 via a double acting hinge 260. A double acting hinge 260 of FIG. 2*b* is mechanically connected to the armature 205 at one end, and to the spring 255 at the other end. A spring 255 is fixed at a position along a line 265 which is perpendicular to the translation line 114 and which intersects the translation line 114 within the gap between the two desired possible positions of the armature 205, so that a movement of the armature 205 along the translation line 114 is transferred, via the double acting hinges 260, to a compression of the spring 255 along the line 265.

In yet another implementation, the bi-stable mechanism is intrinsic to the force provision system 201. This can for example be the case when a force provision system based on attraction or repulsion of permanent magnets is used, as described in "Totally maintenance-free: new vacuum circuit-breaker with permanent magnet actuator" by E. Dullni; H. Fink; G. Hörner; G. Leonhardt; C. Reuber, Elektriziätswirtschaft, 1997, no 11, pp. 1205-1212. Yet other types of bi-stable mechanisms can alternatively be used.

Upon closing of the switch which connects a Thomson coil 202 to the current source, a large current will flow through the Thomson coil 202 thus generating a strong magnetic field around the Thomson coil 202. This magnetic field will in turn induce eddy currents in the armature 205, and the armature 205 will be repelled from the Thomson coil 202 by an electromagnetic force. If the current through the Thomson coil 202 is large enough, a very fast acceleration of the armature 205 can be achieved. The armature 205, which forms part of the transmission link 204, is mechanically linked to the moveable contact 110 of the current interrupter 100. Hence, a strong acceleration of the armature 205 will cause a strong acceleration of the moveable contact 110 (although, as will be seen below, the acceleration/deceleration will not necessarily be the same). Thus, a fast opening of a current interrupter 100 can be achieved by an actuator system 200 where the force provision system 201 is based on Thomson coils 202. As mentioned above, other types of force provision systems 201 can also give rise to a high acceleration of the moveable contact 110.

However, if the moveable contact 110 is given a high speed in an opening operation, there is a risk that the actuator system 200 and moveable contact 110 will be damaged when the travelling parts are brought to a halt at the position representing an open state of the current interrupter 100 (cf. FIG. 1*b*), unless an efficient damping system is in use.

According to the invention, an actuator system 200 comprises a damping system which includes a shock-absorbing mass, which shock-absorbing mass is located so that when the transmission link 204 is to be brought to a halt during an opening operation of the current interrupter 100, the transmission link 204 will collide with the shock-absorbing mass and transfer at least part of the momentum of the travelling parts to the shock-absorbing mass. The shock-absorbing mass is not mechanically linked to the transmission link 204, but the shock-absorbing mass can move independently of the transmission link 204.

By use of the actuator system 200 which includes a shock-absorbing mass, to which at least a part of the momentum of the travelling parts can be transferred during an opening scenario, the travelling parts can be decelerated and brought to a halt over a very short distance, without causing any damage to the armature 205 or to any parts of the actuator system located at the final position of the armature 205 (e.g. the farther Thomson coil 202*b*). Hence, such actuator system 200 can be used for fast actuation of current interrupters 100 of a wide range of stroke lengths S1.

This actuator system opens up for the use of conventional mechanical current interrupters, which up till now have been too slow, also in applications where a fast opening action is required. Examples of such conventional mechanical interrupters are commercially available AC circuit breakers based on vacuum interrupter technology, and other similar interrupters. The invention could also be applied to current interrupters of larger contact stroke S1. In fact, the invention is applicable to any mechanical current interrupter 100 for which the opening action can be performed by means of a translational movement of the transmission link 204.

The shock-absorbing mass of the inventive actuator system 200 is located along the line of translational movement of the travelling parts during an opening or closing action, i.e. along the translation line 114. Furthermore, the shock-absorbing mass will be located at the farther side of the transmission link 204 as seen from the current interrupter 100, i.e., the transmission link 204 will be located between the shock-absorbing mass and the current interrupter 100.

Figure 3:
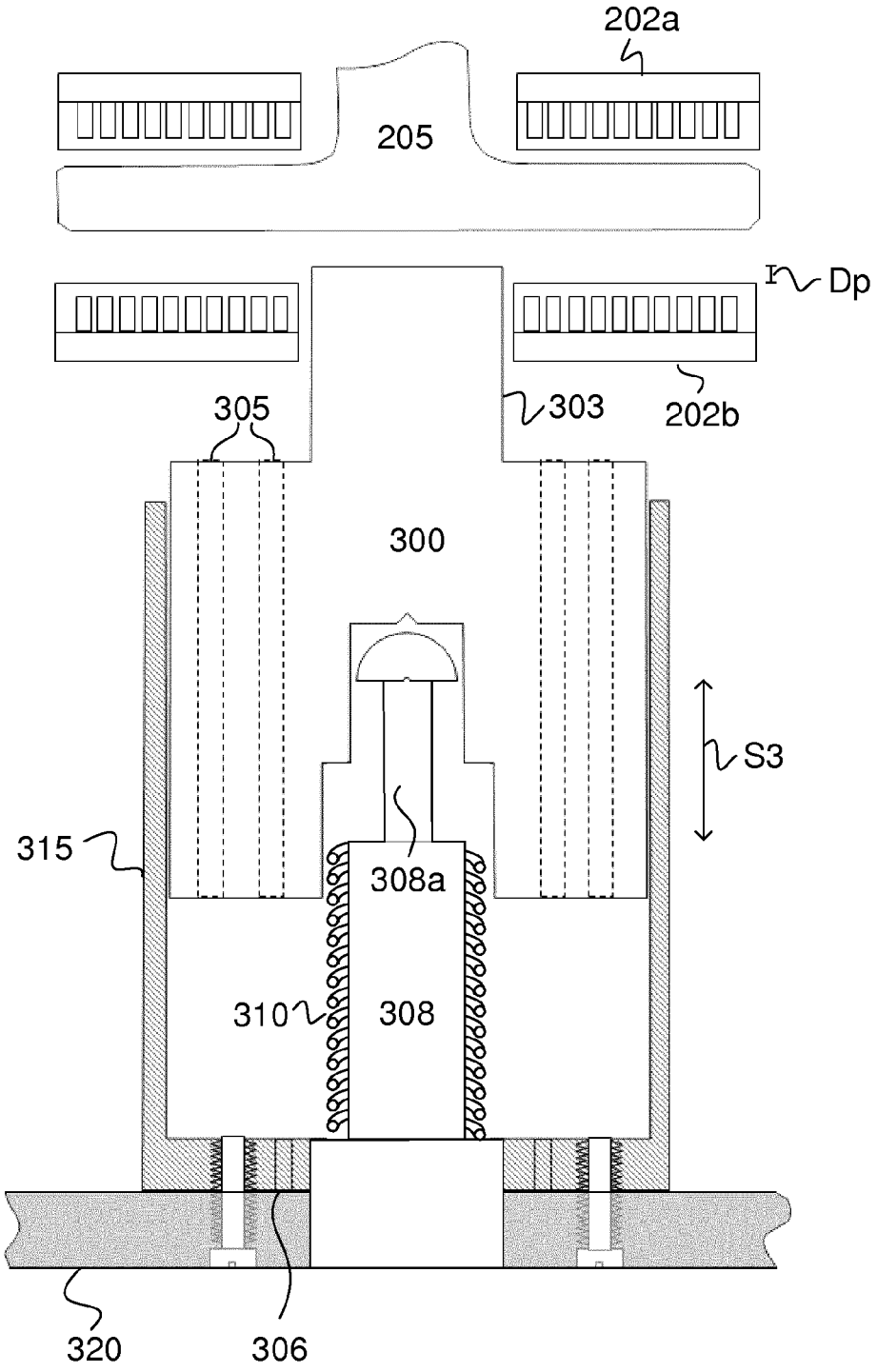
FIG. 3 illustrates an example of a damping system comprising a shock-absorbing mass.

A schematic illustration of an example of a damping system comprising a shock-absorbing mass 300 is shown in FIG. 3. In the actuator system 200 shown in FIG. 3, the force provision system 201 comprises Thomson coils 202*a,b*, and the transmission link 204 is equipped with an armature 205.

When the interrupter 100 is in its closed position, the shock-absorbing mass 300 of FIG. 3 protrudes through a hole in the farther Thomson coil 202*b*, which hole is located at the center of the farther Thomson coil 202*b*. The extension of this protrusion along the translation line 114 is indicated in the drawing by the line Dp, and is referred to as the protrusion distance. If the mass of the shock-absorbing mass 300 is selected with care (see below), the protrusion distance Dp can be in the order of 1-2 millimeters (or smaller), thus allowing for the transmission link 204 to travel at a high speed through a large part of the contact stroke S1, even if the contact stroke S1 is as small as 15 mm or less. If the contact stroke S1 so allows, the protrusion distance Dp could be larger.

When the shock-absorbing mass 300 is hit by the transmission link 204 headed by the armature 205 in an opening operation, the shock-absorbing mass 300 will be sent off at high speed along the translation line 114, in the direction away from the current interrupter 100. In order to avoid that the shock-absorbing mass 300 causes damage to itself or other parts of the actuator system 200, the damping system can for example further comprise a damper 308. FIG. 3 shows an example of a damper 308 which comprises a stem 308*a*. The stem 308*a* of FIG. 3 can move a maximum distance S3 relative to the main part of the damper 308, S3 corresponding to the stroke of the damper 308. The damper 308 of FIG. 3 is located along the translation line 114 on the farther side of the shock-absorbing mass, and is arranged to damp an impact along the translation line 114, from the direction of the current interrupter 100.

An advantage of using a damping system comprising a shock-absorbing mass 300 is that the contact stroke S1 of the current interrupter 100 can be very short, since a majority of the momentum in an opening action is transferred from the travelling parts, via the transmission link 204 which is mechanically connected to the moveable contact 110, to the shock-absorbing mass 300, which can move independently of moveable contact 110. This transfer of momentum takes place within a very short distance. The damper 308 of FIG. 3 is arranged to damp the motion of the shock-absorbing mass 300, which can move independently of the moveable contact 110. Thus, the stroke S3 of the damper 308 can be selected independently of the contact stroke S1, and a damper stroke S3 which is sufficient for conventional damping can be used.

Conventional damping techniques could be used for the damper 308 of FIG. 3. The damper could for example be an oil-gas damper, an air damper, an electromagnetic damper, a sandbag based damper, a damper based on damping foam, etc.

A damping system can further comprise a return spring 310 as shown in FIG. 3, or another mechanism arranged to return the shock-absorbing mass 300 to its initial position when the current interrupter 100 has been opened. The return spring 310 of FIG. 3 is arranged to apply a force on the shock-absorbing mass 300 in the direction towards the current interrupter 100 along the translation line 114. The return spring 310 could for example be a helical spring, a linear spring or a latch, or any other mechanism which returns to its original position after having been displaced. The return spring 310 could advantageously be designed so that in the closed position of the current interrupter 100, the shock-absorbing mass will protrude a pre-determined protrusion distance Dp into the space between the two Thomson coils 202*a,b*. Furthermore, the strength of the return spring 310 could advantageously be such that the return of the shock-absorbing mass to its original position will occur only after the armature 205 has come to a halt.

The damping system shown in FIG. 3 further comprises a housing 315 arranged to guide the shock-absorbing mass 300 towards the damper 308, and a support frame 320 onto which the actuator system 200 is arranged.

The shock-absorbing mass 300 could for example be made from a metal such as steel, aluminum, copper, brass etc, or any other material of suitable density and mechanical properties. In FIG. 3, the shock-absorbing mass 300 is shown to be of cylindrical shape, with a stem 303 protruding into the space between the position of the farther end of the armature 205 in the open and closed states, respectively, of the current interrupter 100, respectively. In order to minimize any damage to the shock-absorbing mass 300 upon a collision with the armature 205, the stem of the shock-absorbing mass could for example be of cylindrical shape. Alternatively, the cross section of the shock-absorbing mass 300 could be of another shape, such as rectangular, hexagonal, or any other suitable shape. If desired, the shock-absorbing mass 300 could have the same cross sectional area all along the translation line 114, instead of being divided into a stem 303 and a main part. Other shapes could also be contemplated. Air ducts 305 through the shock-absorbing mass 300 and/or air ducts 306 through the housing 315 could be beneficial to let out air present in the space between the shock-absorbing mass 300 and the housing 315 when the shock-absorbing mass 300 travels through this space, cf. FIG. 3.

As described above, a minor part of the shock-absorbing mass 300 protrudes, in the closed position of the current interrupter 100, into the space between the Thomson coils 202*a, b* in order to allow for a collision between the travelling armature 205 and the shock-absorbing mass 300. A major part of the shock-absorbing mass 300, on the other hand, is located externally to this space. In one embodiment, the shock-absorbing mass 300 is made up of a plurality of smaller objects, such as a large number of steel spheres, sand particles or similar, which are enclosed in a deformable container, such as a bag. Parts of these smaller objects, or a part of a piston (or similar) which is mechanically connected to these smaller objects, would then protrude into the space between the Thomson coils 202*a,b*, while the major part of the smaller objects would be located externally to the space between the Thomson coils 202*a,b*. Upon a collision between the armature 205 and the smaller objects (or the piston), the smaller objects would then take up a major part of the kinetic energy of the travelling parts when the smaller objects would be re-arranged within the deformable container. This embodiment of the damping system could further include a shape recovery mechanism, corresponding to the recovery spring 310, which could for example include a spring inside the deformable container. In this embodiment, damping could be obtained without the use of a separate damper 308, since the plurality of spheres could themselves act as a damper 308.

In order to further reduce the risk of damage upon opening of the current interrupter 100, the transmission link 204 can comprise a spring arranged to mitigate the shock experienced by the moveable contact 110 when the transmission link 204 collides with the shock-absorbing mass, such spring here being referred to as a shock-mitigation spring. A shock-mitigation spring provides elasticity to the transmission link 204 along the translation line 114. By use of a shock-mitigation spring in the transmission link 204, the acceleration/deceleration of the moveable contact 110 will be different to the acceleration/deceleration of the armature 205. For example, when the armature 205 hits the shock-absorbing mass 300 in an opening action, the deceleration of the armature 205 will be considerably higher than the corresponding deceleration of the moveable contact 110. The risk of the moveable contact 110 being damaged during an opening action will thus be reduced.

The moveable contact 110 is typically made of copper, which material has a high electrical conductivity, but also a comparatively high mechanical plasticity in terms of high ductility and malleability. Hence, if the moveable contact 110 repeatedly experiences a very high deceleration, there is a risk that the moveable contact will be deformed. By use of a shock-mitigation spring, this risk can be greatly reduced.

In FIG. 4, an example of the travelling parts 402 is shown where the transmission link 204 comprises a shock-mitigation spring 400. The transmission link 204 of FIG. 4 is connected to a moveable contact 110, via a connection interface 401, to form the travelling parts 402. The transmission link 204 of FIG. 4 comprises an armature 205 and a drive rod 210 which are mechanically connected in a stiff manner.

The shock-mitigation spring 400 could for example be formed from a set of disc springs, as shown in FIG. 4. Disc springs can typically provide a high force within a small spring compression distance. Different disc springs forming the shock-mitigation spring 400 in this embodiment could be of the same spring constant, or of different spring constants. Furthermore, the different springs could be orientated in the same or the opposite manner in different patterns. Other types of springs could alternatively be used. Shock-mitigation spring 400 could be formed from one or more helical springs or gas springs.

The travelling parts 402 of FIG. 4 further comprises a spring housing 405 which houses the shock-mitigation spring 400 and guides the shock-mitigation spring 400 upon compression. The spring housing 405 of FIG. 4 is stiffly connected to the drive rod 210, and further has an opening 410 at the end directed towards the moveable contact 110, through which a spring guide 420 is mounted. The housing 405 has a stop flange 415 arranged on the inner edge of the opening 410, the stop flange 415 for cooperating with a corresponding flange 417 on the spring guide 420. The stop flange 415 of the spring housing and corresponding flange 417 on the spring guide 420 ensure that the spring guide 420 remains at least partly inside the housing 405, and that a pulling force acting on the armature 205 will be transmitted to the moveable contact 110 when the flanges interact. The shock-mitigation spring 400 of FIG. 4 is located in the spring housing 405, between the spring guide 420 and the end of the spring housing 405 which is opposite the opening 410 through which the spring guide 420 is mounted. The shock-mitigation spring 400, the spring housing 405 and the spring guide 420 have jointly been indicated by reference numeral 403 in FIG. 4, and can be referred to as a shock-mitigation spring mechanism 403 comprising a shock-mitigation spring. Other designs of shock-mitigation spring mechanism 403, whereby a nearer mass including the moveable contact 110 will be hooked to a farther mass including the armature 205 upon pulling of the farther mass, can also be used.

In an opening action of a current interrupter 100 connected to the transmission link 204 of FIG. 4, the spring guide 420 will, upon deceleration of the moveable contact 110 as the armature 205 collides with the shock-absorbing mass 300, compress the shock-mitigation spring 400, and thereby exert a decelerating force on the moveable contact 110. The shock-mitigation spring 400 ensures that the deceleration of the moveable contact 110 will be lower than the deceleration of the armature 205 when the armature 205 collides with the shock-absorbing mass 300.

The presence of the shock-mitigation spring 400 in the transmission link 204 will separate the mass of the travelling parts into two (linked) masses which can be subject to different acceleration/deceleration: A first mass M1 located on the farther side of the spring housing 405, this mass being referred to as the farther mass of the travelling parts; and a second mass M2 located between the spring housing 405 and the fixed contact 105, this mass being referred to as the nearer mass of the travelling parts. The farther mass M1 includes the mass of the armature 205, and the nearer mass M2 includes the mass of the moveable contact 110. Since the acceleration of the nearer and the farther masses will be different, and the speeds of the nearer and farther mass will generally not be the same, the two masses will typically collide with each other during an opening action. The shock-mitigation spring 400 will reduce the risk of damage being caused by such collisions, as well as reduce the frequency of such collisions.

The drive rod 210 could advantageously be made from a material which is sturdy in relation to the forces expected on the drive rod 210 upon actuation of the current interrupter 100. Low elasticity, high yield strength and low density are desired properties of the material. In one implementation, the drive rod is made of an electrically insulating material, examples of which are re-inforced epoxy resins, para-aramids, etc. Such materials could for example be multi-layered, the drive rod 210 for example being made from a multi-layered re-inforced para-aramid. In another implementation, where the armature and the force provision system 210 are at the same electrical potential as the moveable contact 110, the drive rod 210 could be made from a metallic material, such as steel.

The actuator system 200 should be arranged such that when the current interrupter 100 is in the closed position, the moveable contact 110 is in galvanic contact with the fixed contact 105. Thus, the compression, if any, of the shock-mitigation spring 400 in the closed position, should result in a force along the translation line 114 which is less than the force exerted by the bi-stable mechanism (intrinsic or external) along this line. Since the spring constant of the shock-mitigation spring 400 is strong, this means that only a small compression of the shock-mitigation spring 400 can be accepted in the closed state of the current interrupter 110.

In order to ensure that the fixed and moveable contacts will be in good galvanic contact, even if the surfaces of the fixed or moveable contacts will be worn, the actuator system 200 may include a spring, which is of a considerably lower spring constant than the shock-mitigation spring 400, and which is arranged to exert a force on the moveable contact 110 towards the fixed contact 105 when the current interrupter 100 is in its closed position. Such spring will be referred to as a contact spring. Since a suitable force (i.e. a force smaller than the force exerted by the bi-stable mechanism along the translation line 114 ($F_{bistable}$) but large enough to ensure galvanic contact) is desired both when the contact surfaces are new and when they are worn, the compression of the contact spring in the closed state of the interrupter 100 could advantageously exceed, when the contact surfaces are new, a distance corresponding to the expected wear of the contact surfaces. Hence, the spring constant $k_{500}$ of a contact spring 500 could be selected to fulfill the following relation:

$$k_{500}d_{pre\text{-}compression}<F_{bistable} \quad (1)$$

where $d_{pre\text{-}compression}$ is the desired pre-compression of the contact spring 500 when the contact surfaces are new. For a high voltage current interrupter, the value of the desired pre-compression could for example lie within the range of 0.5-5 mm, although other pre-compression distances could be beneficial in some implementations.

Figure 5:
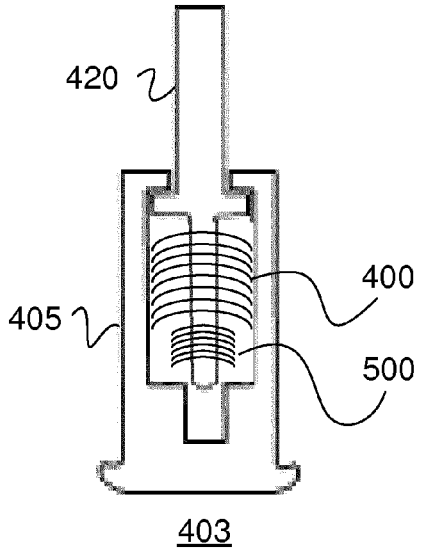
FIG. 5 illustrates an example of a spring housing comprising a shock-mitigation spring as well as a contact spring, where the shock-mitigation spring and the contact springs are co-located in the same spring housing.
Figure 8:
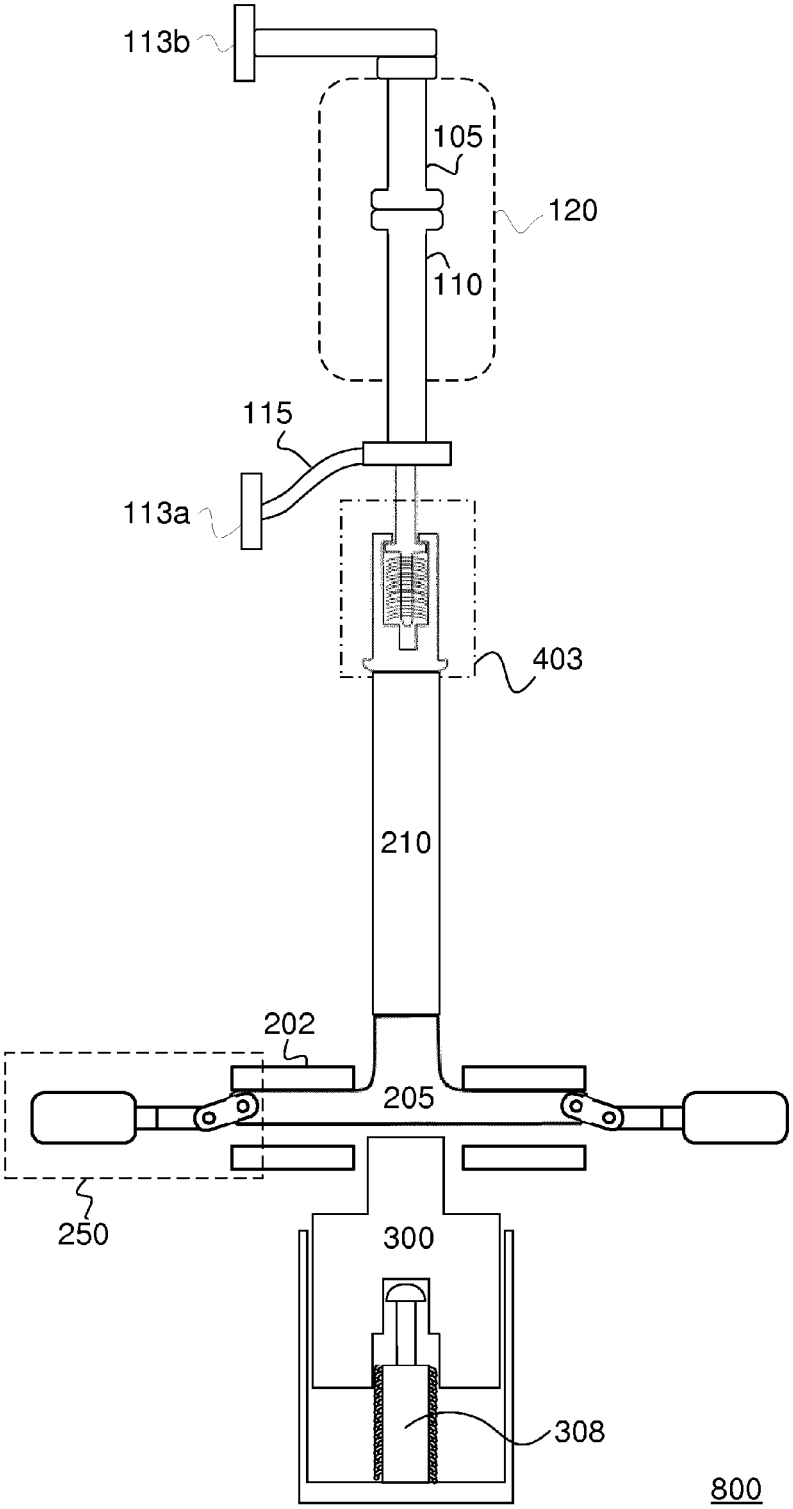
FIG. 8 illustrates an example of an actuator system.

An example of a shock mitigation spring mechanism 403 wherein a contact spring 500 is co-located with a shock-mitigation spring 400 in a spring housing 405 is shown in FIG. 5. The contact spring 500 could e.g. be implemented by means of disc springs or by one or more helical spring, or in any other suitable way. The spring constant of the contact spring 500 is typically considerably lower than the spring constant of a shock-mitigation spring 400. In FIG. 5, the contact spring 500 is implemented by means of disc springs that are stacked, oriented in the same direction, while the contact spring embodiment shown in FIG. 8 is implemented by means of disc springs in an arrangement where the orientation of a disc spring is opposite to the orientation of its neighbouring disc springs. Other disc spring arrangements could alternatively be used.

Hence, in the embodiment of FIG. 5 where a shock-mitigation spring 400 and a contact spring 500 are co-located in a spring housing 405, the length of the cavity of the spring housing 405 should preferably be smaller than the length of the shock-mitigation spring 400 plus the length of the contact spring 500 in their neutral positions, the difference at least exceeding the distance corresponding to an acceptable wear of the contact surfaces.

By providing a contact spring 500, if any, at the location of the shock-mitigation spring 400, has the advantage that the travelling parts will be separated into two linked masses only (the nearer and farther masses as described above), and the presence of the shock-mitigation spring 400 between these masses will ensure that the risk of damage caused if these linked masses collide will be reduced. In the example shown in FIG. 5, the shock-mitigation spring 400 and the contact spring 500 are adjacent to each other.

The spring constant $k_{500}$ of the contact spring 500 could advantageously fulfill expression (1). The spring constant $k_{400}$ of the shock-mitigation spring 400, on the other hand, will typically be considerably higher than the spring constant of the contact spring 500. Typically, the spring constant of the shock-mitigation spring 400 will be an order of magnitude larger than the spring constant of the contact spring 500, or more. $k_{400}$ will be selected such that a small compression of the shock-mitigation spring 400 will give rise to a large force. Typically, $k_{400}$ will be selected such that the compression distance, at which the shock-mitigation spring 400 gives rise to a force exceeding the force provided by the bi-stable mechanisms 250, will be less than 10% of the stroke of the shock mitigation spring 400.

In the illustration of the travelling parts shown in FIG. 4, the shock-mitigation spring 400 is located between the drive rod 201 and the moveable contact 110. By providing the shock-mitigation spring 400 close to the moveable contact 110, a large part of the mass of the travelling parts will be located on the farther side of the shock-mitigation spring 400. When the force provision system 201 is arranged such that the force acting on the armature 205 is the largest in the initial stage of the opening action, and this force is exerted at the farther end of the transmission link, this location of the shock-mitigation spring 400 can be advantageous, in particular if the transmission link 204 includes a spring which is pre-compressed in the closed position of the current interrupter 100. For example, for a force provision system 201 based on Thomson coils, the strength of the repulsive force decreases when the distance between the Thomson coil 202 and the armature 205 increases. In an actuator system 200 wherein the transmission link 204 experiences a pre-compression, the force generated by means of force provision system 201 will, in an opening action, mainly act on the mass which is located on the farther side of the shock-mitigation spring 400, until any pre-compression of the spring(s) has been released. Thus, if the generated force is largest at the initial stage, it is advantageous to provide the shock-mitigation spring 400 at a location which is closer to the moveable contact 110, so that a larger part of the mass will experience the larger force. However, other locations of the shock-mitigation spring 400 could alternatively be used.

Figure 6:
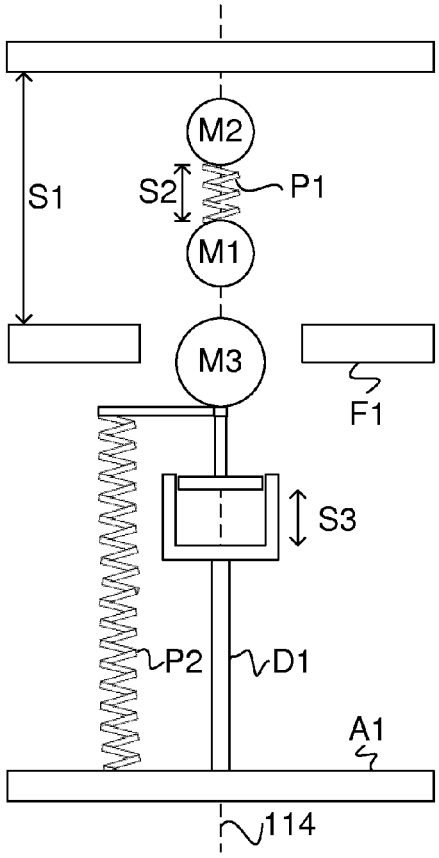
FIG. 6 is a schematic illustration of a mechanical system including three masses M1, M2 and M3, where M1 and M2 are linked by means of a spring P1.

The dynamics of an opening action of an actuator system 200 comprising a shock-absorbing mass 300 and shock-mitigation spring 400 will now be further described. The typical opening-action dynamics of an actuator system 200 having a shock-absorbing mass 300 and a transmission link 204 which includes a pre-compressed spring can be described with reference to FIG. 6. FIG. 6 is a schematic illustration of a mechanical system including three masses M1, M2 and M3. Masses M1 and M2 are linked via a spring P1, and mass M3 is linked to a support Al by means of a damper D1 and a spring P2. P1 represents the combination of a shock-mitigation spring 400 and a contact spring 500, if any, while the masses M1 and M2 represent different parts of the travelling parts 402: the nearer mass M2 represents the mass located between the shock-mitigation spring 400 and the fixed contact 105, while the farther mass M1 represents the part of the transmission link 204 which is located on the farther side of the shock-mitigation spring 400. The mass M2 includes the mass of the moveable contact 110, while the mass M1 includes the mass of the armature 205. M3 represents the shock-absorbing mass 300. D1 represents a damper 308, the spring P2 represents a return spring 310, while the force provision system 201 is represented by F1 in FIG. 6. The distance S1 of FIG. 6 corresponds to the contact stroke S1, the distance S2 represents the maximum relative displacement between the masses M1 and M2, and the distance S3 represents the stroke of the damper 308, which will also be the maximum stroke of the mass M3 representing the shock-absorbing mass 300.

When an actuating force is applied upon opening of the current interrupter 100, the farther mass (M1) of the travelling parts 402 will commence a displacement at high speed towards the shock-absorbing mass 300 (M3). Initially, the farther mass (M1) will be accelerated almost independently of the mass (M2) on the nearer side of the shock-mitigation spring 400, since the spring (P1) has been in a pre-compressed state. When the mass (M1) on the farther side is displaced towards the shock-absorbing mass 300 (M3) so that the pre-stress of the spring P1 has been released, a force will be exerted on the mass M2 on the nearer side, which mass will then also be accelerated. In the embodiment shown in FIG. 4, this acceleration of the nearer mass M2 will start when the spring guide flange 417 reaches the stop flange 415 of the housing 405. At this moment, the farther mass M1 will be decelerated, while the nearer mass M2 will be accelerated. If the spring constant of the spring P1 is within a suitable range, any further expected collision between these farther and nearer masses will be mitigated by the spring P1. However, if the spring P1 is too weak, for example if the spring P1 is a sole contact spring 500 which fulfills expression (1), there is an risk of multiple, un-dampened, collisions between the transmission link 204 and the moveable contact 110. A moveable contact 110 made of a soft material such as Cu, could be damaged in such collisions.

When the farther mass (M1) collides with the shock-absorbing mass 300 (M3), the farther mass (M1) will more or less instantly loose a part of its momentum to the shock-absorbing mass 300 (M3), which in turn will be sent off at high speed along the translation line 114 (or be deformed in case the shock-absorbing mass 300 includes a large number of smaller objects). When the farther mass (M1) greatly slows down within an instant, the nearer mass (M2) will continue to travel towards the farther mass (M1), under a deceleration force exerted by the spring P1. Thus, if carefully selected, the spring P1 will ensure that the deceleration of the moveable contact 110 will be lower than the deceleration of the armature 205 upon collision of the armature 205 with the shock-absorbing mass 300, thus reducing the risk that the moveable contact 110 (and the drive rod 210) will be damaged.

The more or less instant deceleration of the farther mass (M1) upon collision with the shock-absorbing mass 300 (M3) can either result in a slowdown, after which the farther mass (M1) still moves in the same direction; in a complete stop, after which the farther mass (M1) stands still; or in a change of direction, after which the farther mass (M1) moves in the opposite direction, towards the moveable contact 110. A movement in either direction will be acceptable, as long as the speed is low enough so that no damage will be made to the parts of the actuator system 200 in any further collisions that may occur. For example, in one example of an actuator system 200, a reduction by 50% in the kinetic energy of the farther mass M1 in the collision with the shock-absorbing mass would be sufficient.

Whether a slowdown, a complete stop or a change in direction will occur depends inter alia on the ratio of the shock-absorbing mass 300 (M3) to the mass of the travelling parts (M1+M2). In order to obtain an efficient breaking of the travelling parts, a suitable value of the mass $M_{shock\text{-}abs}$ of the shock-absorbing mass 300 could for example lie between 0.9 $M_{travel}$ and $M_{travel}$, where the range is expressed in terms of the total mass $M_{travel}$ of the travelling parts, i.e. the sum of the mass of the transmission link 204 and the mass of the moveable contact 110. With this relation between $M_{travel}$ and $M_{shock\text{-}abs}$, the travelling parts 402 will typically continue in the same direction but at a highly reduced speed after the collision with the shock-absorbing mass. However, the mass $M_{shock\text{-}abs}$ could in some implementations lie outside this range, and for example lie within the range of 0.75 $M_{travel}$ to 1.25 $M_{travel}$, or within the range of 0.5 $M_{travel}$ to 1.5 $M_{travel}$.

Due to the presence of the shock-mitigation spring 400, the effective momentum of the travelling parts at the moment of collision is not so easy to predict. Although a slow movement of the transmission link 204 in the forward direction after the collision is often desired in order to keep the stress on the moveable contact 110 at a minimum value, a complete stop, or a slow movement in the reverse direction, would generally be acceptable.

Figure 7:
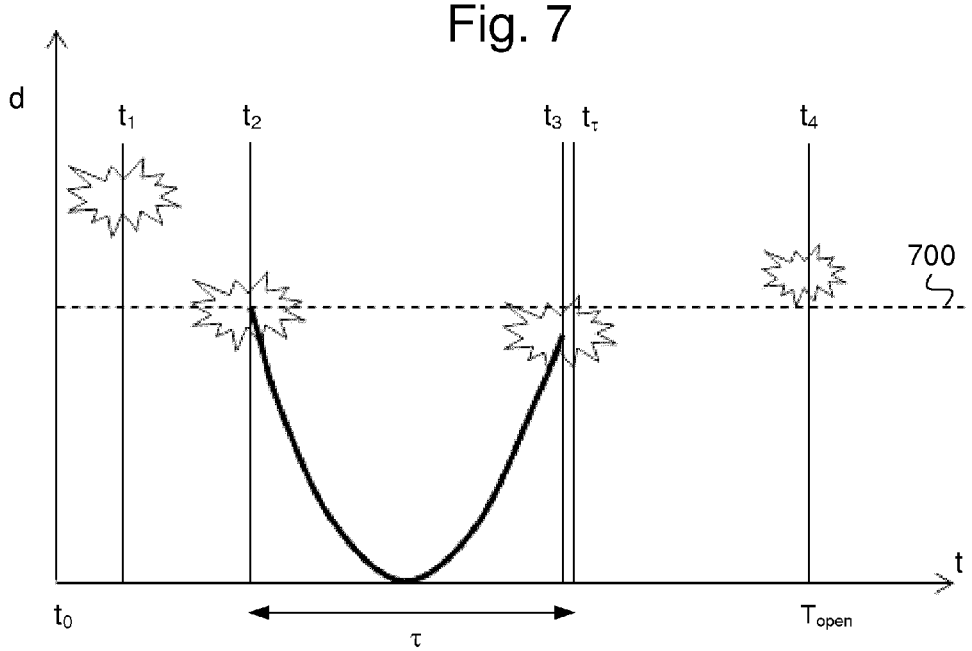
FIG. 7 is a graph illustrating the relative distance d between the nearer and further masses as a function of time for a part of an example of an opening scenario.

When dimensioning the shock-mitigation spring 400, a desired opening scenario wherein the number of collisions between the nearer mass M2 and the farther mass M1 is kept to a minimum could be considered. In FIG. 7, a desired function of the relative displacement d between the nearer and farther masses is shown as a function of time t for an actuator system 200 which comprises a contact spring 500 and a shock mitigation spring 400. A desired relative displacement d as a function of time has been indicated only for the time interval between the times $t_2$ and $t_3$, the significance of these times being further described below. A dashed line 700 is indicated at the relative distance d corresponding to the contact spring 500 being fully compressed and the shock-mitigation spring 400 being in its neutral position.

FIG. 7 is illustrated in relation to an example of an actuator system 200 which comprises a shock-mitigation spring 400 and a pre-compressed contact spring 500. However, the reasoning below applies also to actuator systems 200 where no contact spring 500 is present. The opening scenario can be described in relation to FIG. 7 as follows: The total opening time is $T_{open}$. At time $t_0$, the opening of the current interrupter 100 is actuated, and the farther mass M1 including the armature 205 starts to accelerate along the translation line 114, away from the fixed contact 105. At time $t_1$, the farther mass has traveled a distance corresponding to the pre-compression of the contact spring 500, and a collision between the farther mass M1 and the nearer mass M2 occurs in that the nearer mass M2 is accelerated by the farther mass M1 in a pulling action. This collision sets the nearer mass M2, including the moveable contact 110, in motion towards the farther mass M1, while the farther mass M1 is slowed down. At time $t_2$, the nearer mass M2 collides with the shock-mitigation spring 400, which starts to be compressed. At time $t_3$, the farther mass M1 collides with the shock-absorbing mass 300. At time $t_4$, the armature 205 reaches its final position and the opening scenario is completed.

If the spring constant of the shock-mitigation spring 400 is too weak or too strong, the nearer mass M2 will oscillate in relation to the farther mass M1 between times $t_2$ and $t_3$, and there will be a series of further collisions which will be unpredictable. Such collisions could be damaging to the moveable contact 110, and can be avoided by selecting a suitable spring constant for the shock-mitigation spring 400. In FIG. 7, a desired function of the relative displacement d between the nearer and farther masses is shown between the times $t_2$ and $t_3$: In order to reduce the number of collisions between the nearer and farther masses, it would be advantageous if the period of the oscillations between the nearer and farther masses is such that the collision with the shock-absorbing mass 300 at $t_3$ occurs shortly before half an oscillation period has been completed since the occurrence of the collision between the nearer mass and the shock-mitigation spring 400 at $t_2$. Hence, the time between $t_2$ and $t_3$, here referred to as $\Delta t_{23}$, should be less than half the oscillation period. In FIG. 7, half the oscillation period has been indicated as $\tau$, i.e. the oscillation period of the system comprising the masses M1 and M2 and the shock-mitigation spring 400 is $2\tau$ (the time $t_2+\tau$ has been indicated in FIG. 7 as $t_\tau$). Thus, the following relation could advantageously hold:

$$\Delta t_{23}<\tau \tag{2}$$

The desired spring constant $k_{400}$ of the shock-mitigation spring 400 can then be expressed in terms of $\tau$ as:

$$k_{400}=\left(\frac{M1M2}{M1+M2}\right)\left(\frac{2\pi}{2\tau}\right)^2 \tag{3}$$

A suitable value of the half period $\tau$ can for example be chosen to from the range of $0.2T_{open}$ to $0.5T_{open}$. The time $\Delta t_{34}$ which elapses between the collision with the shock-absorbing mass 300 and the arrival of the armature 205 at its final position will typically be comparable to $\tau$, since the speed of the travelling parts will be slow during this period, while the time $\Delta t_{02}$ from actuation at time $t_0$ to the collision between the nearer mass and the shock-mitigation spring 400 will often be smaller. However, $\tau$ could also be chosen from a wider range, for example $0.1T_{open}$ to $0.7T_{open}$.

The masses of the nearer mass and the farther mass can for example be approximately equal, so that the ratio between the two masses lies within the range of 0.8 to 1.2. By designing the actuator system so that the nearer and farther masses are approximately equal, the two masses will travel more or less together in the part of the opening scenario which occurs after the transmission link has collided with the shock-absorbing mass, thus reducing the risk of further collisions. This effect will be more pronounced as the ratio approaches 1, for example if the ratio of the two masses lies between 0.9 and 1.1.

One example of an implementation of a current interrupter system having a current interrupter 100 which is actuated by an actuation system 200 is shown in FIG. 8.

In FIG. 8, the actuator system 200 is shown to be arranged in a vertical manner with the current interrupter 100 on top. However, the actuator system 200 could be turned around, so that the current interrupter 100 is at the bottom, or so that the actuator system 200 has a horizontal orientation, or in any other suitable way depending on the circumstances. The position of the return spring 310, if any, would then typically have to be modified. The actuator system 200 is typically mounted on a heavy and stable frame or support (not shown) in order to provide a robust actuator system 200. For example, each of the Thomson coils 202*a,b* could be attached to such frame, as well as the interrupter housing/flask 120, supporting legs, etc.

Using the above described technology, an actuator system 200 can be designed which can provide opening times as short as 5 ms or less for a high voltage current interrupter.

The above discussion has been made in relation to a desire to obtain a very fast actuation of a current interrupter 100 in an opening action. For a closing action of the current interrupter 100, the requirements on speed are often not as strict, meaning that a longer duration of the closing action than of the opening action is generally acceptable. Therefore, in one embodiment, the actuator system 200 is arranged to provide a smaller force in the closing action than in the opening action. This could for example be achieved by connecting the nearer Thomson coil 202*a* to a first capacitor system and connecting the farther Thomson coil 202*b* to a second capacitor system, where the first capacitor system is arranged to provide a higher current than the second capacitor system. Alternatively, or additionally, the nearer Thomson coils 202*a* could be larger than the further Thomson coil 202*b*. If the actuating force will be smaller upon closing than upon opening of the current interrupter 100, requirements on damping of the transmission link 204 upon closing will be smaller. In some implementations, the damping provided by the shock-mitigation spring 400 would be sufficient. In other implementations, a traditional damping system, e.g. and oil-based or an air based system, or an electromagnetic force based system, could be used for damping the transmission link 204 at the point of attachment 130 between the fixed contact 105 and the second terminal 113*b*. In a system where the same actuating force is provided upon closing as upon opening, a second shock-absorbing mass could be arranged to provide damping of the fixed contact upon closing. Such second shock-absorbing mass could for example be arranged beyond the fixed contact 105 along the translation line 114 as seen from the transmission link 204. In a current interrupter 100 as shown in FIGS. 1*a* and *b*, a second shock-absorbing mass could for example be arranged at the point of attachment 130 between the fixed contact 105 and the second terminal 113*b*, for example on either side of an connection interface 125*a*.

The above description has, as an example, been given in terms of a force provision system based on a pair of Thomson coils 202*a* and 202*b*. However, as mentioned above, other means of providing the actuating force could alternatively be used. If the actuating force upon opening is provided by a single Thomson coil 202, this single coil would correspond to the nearer Thomson coil 202*a*, and the farther Thomson coil 202*b* would be dispensed with. An alternative force provision system for providing a closing actuation force could then be provided, such as a spring operated mechanism or an electromagnetic force mechanism based on repulsion of permanent magnets. When two different force provision systems are combined in this way, each side of the armature 205 could be arranged in a suitable manner—in case of a combination of a Thomson coil and a repulsion of permanent magnets, for example, the side of the armature 205 which faces the nearer coil 202*a* would be of an electrically conducting material, while the other side would comprise magnets which would be repelled by a current flowing through the farther coil 202*b*.

The above described technology can be used for the design of actuator systems for DC interrupters as well as for AC interrupters. The advantages which can be provided by the actuator system are particularly beneficial for high voltage interrupters, but the technology could also be used for low or medium voltage interrupters. An HVDC breaker comprising a DC interrupter provided with an actuator system in accordance with the described technology often further comprises a non-linear resistor and a resonant circuit, both being connected in parallel with the DC interrupter.

Although various aspects of the invention are set out in the accompanying claims, other aspects of the invention include the combination of any features presented in the above description and/or in the accompanying claims, and not solely the combinations explicitly set out in the accompanying claims.

One skilled in the art will appreciate that the technology presented herein is not limited to the embodiments disclosed in the accompanying drawings and the foregoing detailed description, which are presented for purposes of illustration only, but it can be implemented in a number of different ways, and it is defined by the following claims.

The invention claimed is:

1. An actuator system for actuating a current interrupter having a fixed contact and moveable contact, the actuator system comprising:

a transmission link for transmission of a force to the moveable contact of the current interrupter, the transmission link having a first end which is mechanically connectable to the moveable contact of the current interrupter and a second end facing away from the moveable contact; and a damping system comprising a shock-absorbing mass, the shock-absorbing mass being located along an extension of a line of translational movement of the transmission link, at the farther side of the transmission link as seen from the current interrupter, so that upon an opening operation of the current interrupter, the second end of the transmission link will collide with the shock-absorbing mass, wherein the transmission link comprises a shock-mitigation spring (400) arranged to mitigate the shock experienced by the moveable contact in a damping action, the shock mitigation spring being arranged to provide elasticity to the transmission link in the direction of translational movement of the moveable contact, and the spring constant $k_{400}$ of the shock-mitigation spring fulfills the following relation:

$$k_{400} = \left(\frac{M1M2}{M1+M2}\right)\left(\frac{2\pi}{2\tau}\right)^2,$$

where M1 is the mass of the part of the transmission link which is further away from the moveable contact than is the shock-mitigation spring; M2 is sum of the mass of the moveable contact and the part of the transmission link that is closer to the moveable contact than is the shock-mitigation spring; and $\tau$ takes a value between $0.1T_{open}$ and $0.7T_{open}$, where $T_{open}$ is the opening time of the current interrupter.

2. The actuator system of claim 1, wherein the actuator system is for actuating a current interrupter having an opening time of 5 ms or less; and the value of $\tau$ is 3.5 ms or less.

3. The actuator system of claim 1, wherein the transmission link further comprises a drive rod; and the shock-mitigation spring is arranged between the first end of the transmission link and the drive rod, the drive rod being arranged between the shock-mitigation spring and the second end of the transmission link.

4. The actuator system of claim 1, further comprising a contact spring arranged to be compressed by a pre-defined distance when the current interrupter is in the closed position, so that a spring force is exerted on the moveable contact towards the fixed contact.

5. The actuator system of claim 4, wherein the contact spring is co-located with the shock-mitigation spring.

6. The actuator system of claim 4, wherein the ratio of the spring constant of the shock-mitigation spring to the spring constant of the contact spring takes a value larger than 10.

7. The actuator system of claim 1, further having a bi-stable mechanism arranged to exert a force on the transmission link in the direction towards the moveable contact when the current interrupter is in the closed position; and wherein the shock-mitigation spring provides a spring constant such that the compression, at which the shock-mitigation spring gives rise to a force exceeding said force exerted by the bi-stable mechanism, will be less than 10% of the stroke of the shock-mitigation spring.

8. The actuator system of claim 1, wherein the mass of the shock-absorbing mass lies within the range of 50-150% of the sum of the mass of the transmission link and the mass of the moveable contact.

9. The actuator system of claim 1, wherein the transmission link comprises a drive rod made from a fiber reinforced epoxy resin comprising a para-aramid.

10. An interrupter system comprising:

a high voltage current interrupter having a moveable contact;

an actuator system of claim 1; wherein the moveable contact is connected to the first end of the transmission link of the actuator system.

11. The interrupter system of claim 10, wherein the shock-mitigation spring divides the total mass of the transmission link and the moveable contact into a farther mass and a nearer mass, where the further mass is located further away from the fixed contact than the shock-mitigation spring, and the nearer mass is located nearer to the fixed contact than the shock-mitigation spring, and wherein the ratio of the further mass to the nearer mass lies within the range of 0.8 to 1.2.

12. The interrupter system of claim 10, wherein the high voltage current interrupter is a vacuum interrupter.

13. A high voltage direct current circuit breaker comprising an interrupter system of claim 10.

14. A high voltage alternating current circuit breaker comprising an interrupter system of claim 10.

15. The actuator system of claim 2, wherein the transmission link further comprises a drive rod; and the shock-mitigation spring is arranged between the first end of the transmission link and the drive rod, the drive rod being arranged between the shock-mitigation spring and the second end of the transmission link.

16. The actuator system of claim 2, further comprising a contact spring arranged to be compressed by a pre-defined distance when the current interrupter is in the closed position, so that a spring force is exerted on the moveable contact towards the fixed contact.

17. The actuator system of claim 3, further comprising a contact spring arranged to be compressed by a pre-defined distance when the current interrupter is in the closed position, so that a spring force is exerted on the moveable contact towards the fixed contact.

18. The actuator system of claim 5, wherein the ratio of the spring constant of the shock-mitigation spring to the spring constant of the contact spring takes a value larger than 10.

19. The actuator system of claim 2, further having a bi-stable mechanism arranged to exert a force on the transmission link in the direction towards the moveable contact when the current interrupter is in the closed position; and wherein the shock-mitigation spring provides a spring constant such that the compression, at which the shock-mitigation spring gives rise to a force exceeding said force exerted by the bi-stable mechanism, will be less than 10% of the stroke of the shock-mitigation spring.

20. The actuator system of claim 3, further having a bi-stable mechanism arranged to exert a force on the transmission link in the direction towards the moveable contact when the current interrupter is in the closed position; and wherein the shock-mitigation spring provides a spring constant such that the compression, at which the shock-mitigation spring gives rise to a force exceeding said force exerted by the bi-stable mechanism, will be less than 10% of the stroke of the shock-mitigation spring.

* * * * *